US012156572B1

(12) United States Patent
Kim et al.

(10) Patent No.: US 12,156,572 B1
(45) Date of Patent: Dec. 3, 2024

(54) ADJUSTABLE STRAPS WITH SNAPS AND SLIDING CLASPS

(71) Applicant: Apple Inc., Cupertino, CA (US)

(72) Inventors: Seul Bi Kim, Sunnyvale, CA (US); Ayumi Kusano, Shinagawa (CN); Bryan A. Cloyd, San Francisco, CA (US); Motohide Hatanaka, Menlo Park, CA (US); Sara Rusignuolo, Newport Beach, CA (US); Yang Zhou, San Jose, CA (US); Anthony M. Ashcroft, San Francisco, CA (US); Jack Pickup, Shenzhen (CN)

(73) Assignee: Apple Inc., Cupertino, CA (US)

( * ) Notice: Subject to any disclaimer, the term of this patent is extended or adjusted under 35 U.S.C. 154(b) by 44 days.

(21) Appl. No.: 17/489,481

(22) Filed: Sep. 29, 2021

Related U.S. Application Data

(60) Provisional application No. 63/108,960, filed on Nov. 3, 2020.

(51) Int. Cl.
*A44B 11/06* (2006.01)

(52) U.S. Cl.
CPC ..... *A44B 11/06* (2013.01)

(58) Field of Classification Search
CPC ..... A44B 11/06; A45F 5/00; A45F 2005/002; A45F 2005/006; A45F 2200/0508; A45F 2200/0516; A45F 2200/0525; Y10T 24/4086; Y10T 24/4019; Y10T 24/4005; Y10T 24/1397; Y10T 24/318
See application file for complete search history.

(56) References Cited

U.S. PATENT DOCUMENTS 533,373 A * 1/1895 Presby ..... A41F 15/02 2/112
1,270,494 A * 6/1918 Christiansen ..... B60P 7/0823 24/375
2,121,513 A * 6/1938 Smith ..... A41F 15/02 24/DIG. 16
3,835,505 A * 9/1974 Shewbridge ..... B65D 63/1027 24/339
3,848,270 A * 11/1974 Rand ..... A41F 9/002 2/919
3,977,638 A * 8/1976 Woodard ..... A61J 9/0638 248/102

(Continued)

*Primary Examiner* — Jason W San
*Assistant Examiner* — Rowland Do
(74) *Attorney, Agent, or Firm* — Treyz Law Group, P.C.; G. Victor Treyz; David K. Cole

(57) ABSTRACT

A strap may have a strip of material. A flexible magnet and other layers may be embedded between outer layers of the strip. The outer layers may be formed from leather or other natural materials, fabric, polymer, or other materials. The strap may have a snap mechanism that removably couples the strap to the item. The strip may have left and right portions that are coupled together using sliders and the snap mechanism. The sliders may be fixedly attached to respective end portions of left and right portions of the strip. A first of the sliders may have a slot that allows the first slider to slide along the right strip portion and a second of the sliders may have a slot that allows the second slider to slide along the left strip portion so that the length of the strap may be adjusted.

22 Claims, 16 Drawing Sheets

(56) References Cited

U.S. PATENT DOCUMENTS

| | | | | |
|---|---|---|---|---|
| 4,881,746 | A * | 11/1989 | Andreesen | B62B 9/26 224/558 |
| 4,937,885 | A * | 7/1990 | Gregg | A42B 1/041 2/209.12 |
| 4,982,885 | A * | 1/1991 | Severson | A45F 3/14 24/324 |
| 6,449,815 | B1 | 9/2002 | Spiller | |
| 7,004,113 | B1 | 2/2006 | Zutis et al. | |
| 7,343,649 | B2 * | 3/2008 | Walters, Jr. | F41C 33/0236 24/298 |
| 9,407,743 | B1 | 8/2016 | Hirshberg | |
| 9,730,499 | B2 | 8/2017 | Ford | |
| 10,071,620 | B2 * | 9/2018 | Hunter | B60J 7/104 |
| 10,132,340 | B2 | 11/2018 | Russell-Clarke et al. | |
| 2006/0168766 | A1 * | 8/2006 | Lippincott | A61J 17/111 24/3.13 |
| 2010/0064485 | A1 * | 3/2010 | Blevins | A63B 55/408 24/317 |
| 2012/0192384 | A1 * | 8/2012 | Kelly | F16B 2/08 24/302 |
| 2015/0173476 | A1 | 6/2015 | Beltrán | |
| 2016/0255944 | A1 | 9/2016 | Baranski et al. | |
| 2022/0346531 | A1 * | 11/2022 | Henrot | A45F 3/14 |

* cited by examiner

ADJUSTABLE STRAPS WITH SNAPS AND SLIDING CLASPS

This application claims the benefit of U.S. provisional patent application No. 63/108,960, filed Nov. 3, 2020, which is hereby incorporated by reference herein in its entirety.

FIELD

This relates generally to straps, and, more particularly, to straps with snap and slider mechanisms.

BACKGROUND

It is sometimes desirable to provide items such as electronic devices with straps. Straps may allow devices to be worn or carried by a user.

SUMMARY

An adjustable-length strap may have a strip of material. The strip of material may have exterior surfaces of leather, fabric, or other material and may include one more internal layers such as a flexible magnet layer.

The strap may have a snap mechanism that removably couples the strap to an item such as an electronic device and/or a removable cover for an electronic device. The snap mechanism may have snaps coupled to the strip of material. There may be, as examples, two snaps or three snaps in the snap mechanism.

The strip may have left and right portions that are coupled together using sliders and the snap mechanism. The sliders may be fixedly attached to respective end portions of the left and right strip portions. A first of the sliders may have a slot that allows the first slider to slide along the right strip portion and a second of the sliders may have a slot that allows the second slider to slide along the left strip portion so that the length of the strap may be adjusted.

DETAILED DESCRIPTION

Electronic devices and other items may be provided with straps. For example, a cellular telephone or other electronic device may be provided with a fixed-length or adjustable-length carrying strap. Straps may be held in a user's hands, worn about a user's neck, worn across a user's body, and/or otherwise carried by a user. In some configurations, an electronic device may be provided with a strap that facilitates mounting of the device on the wrist, arm, leg, head, or other body part of a user. For example, a wristwatch may be provided with an adjustable-length wrist strap.

Figure 1:
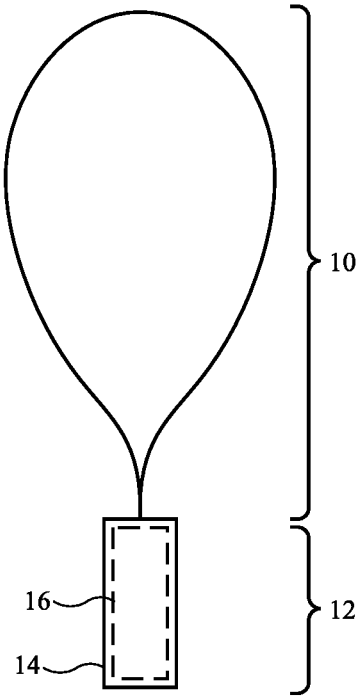
FIG. 1 is a diagram of an illustrative strap and associated electronic device in accordance with an embodiment.

FIG. 1 is a diagram of an illustrative strap and associated item coupled to the strap. As shown in FIG. 1, strap 10 may have a loop that allows strap 10 to be carried by a user. Strap 10 may be a cross-body strap, a wrist strap, a loop that can be held in a user's hand or worn about a user's neck, or other suitable strap. Item 12 may be coupled to strap 10 using a fixed or removable attachment mechanism. As an example, strap 10 may have a snap mechanism that allows strap 10 to be removably attached to item 12.

Item 12 may include an electronic device such as electronic device 16 (e.g., a battery pack, a cellular telephone, a tablet computer, other electronic equipment, etc.) and/or may include a carrying case that is removably attached to device 16 such as removable case 14 (e.g., a removable cover formed from polymer, leather, fabric, etc.). If desired, removable case 14 may incorporate batteries and other circuitry. Device 16 may include a display, buttons, touch sensors, force sensors, optical sensors, microphones for gathering voice input, and/or other sensors and input-output devices for gathering user input and providing a user with output. The user input may be used in controlling the operation of device 16. Carrying case 14 and/or electronic device 16 may be used as stand-alone equipment or may, if desired, be tethered to a head-mounted device or other additional electronic equipment (e.g., additional electronic equipment with input-output devices for receiving user input, for providing a user with output, etc.). When item 12 is used with additional electronic equipment, wired and/or wireless power paths and wired and/or wireless data communications paths may be used to transfer power and/or data between item 12 and the additional electronic equipment.

Figure 2:
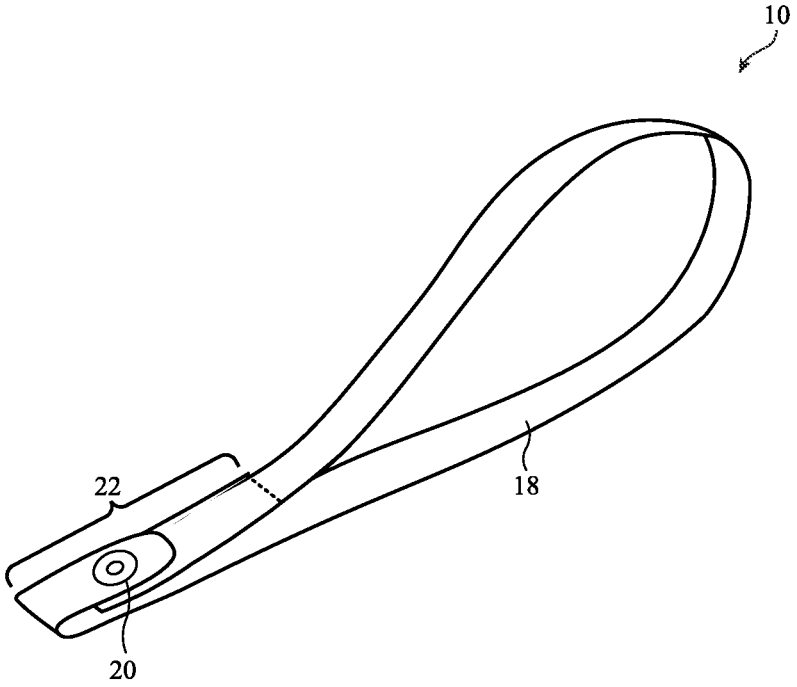
FIG. 2 is a perspective view of an illustrative strap in accordance with an embodiment.

FIG. 2 is a perspective view of an illustrative strap such as strap 10 of FIG. 1. As shown in FIG. 2, strap 10 may be formed from an elongated strip of material such as strip 18. Strip 18, which may sometimes be referred to as a strap or band, may be flexible so that strip 18 may be folded back on itself to form a loop. Strip 18 may be formed from one or more layers of flexible material including polymer, flexible magnets, fabric, flexible metal, adhesive, natural materials such as cotton, other materials, and/or combinations of these materials.

A snap mechanism such as snap mechanism 20 may be used to secure the ends of strip 18. Snap mechanism 20 may have on or more snap elements (sometimes referred to as snaps or snap members) that are detachably snapped together to secure strap 10 to an item (e.g. item 12 of FIG. 2). In some configurations, opposing ends of strip 18 may be attached together using adhesive or other fixed attachment mechanisms and snap mechanism 20 may be used to removably attach a looped protruding end portion of strip 18 to an item. In other configurations, snap mechanism 20 may be used to secure end portions of strip 18 together in addition to removably attaching a looped protruding end portion of strip 18 to an item.

Strip 18 may be formed from a uniform length of material (with one or more sublayers) and/or different segments along the length of strip 18 may have different internal and/or external layer(s) of material. As an example, end portion 22 of strip 18 may have an exterior surface formed from fabric, whereas remaining portions of strip 18 may have an exterior surface formed from leather. If desired, all of strip 18 may be leather or all of strip 18 may be formed from fabric. Polymer layers and/or other materials may also be used to cover some or all of strip 18. For example, the surface of a portion of strip 18 may be covered with a layer of polymer or other material that is not present on other portions of strip 18.

Figure 3:
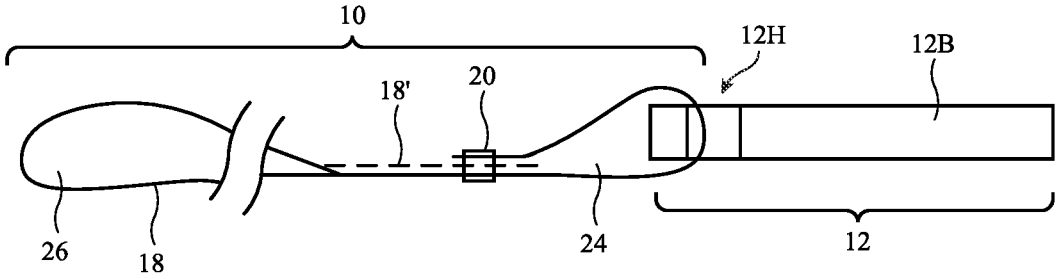
FIG. 3 is a side view of the strap of FIG. 2 coupled to an item in accordance with an embodiment.

FIG. 3 is a cross-sectional side view of an illustrative strap that has been removably attached to item 12. In the example of FIG. 3, item 12 has a body (sometimes referred to as a housing) such as structure 12B with an opening 12H configured to receive a folded back protruding end portion of strip 18. Opening 12H may be, for example, an opening in a removable electronic device cover and/or an opening in an electronic device housing.

As shown in FIG. 3, snap mechanism 20 may be used to secure the looped end of strip 18 to form a first loop such as loop 24 that attaches strap 10 to item 12. Strip 18 may also be used to form a second loop such as loop 26 (e.g., a larger loop) to receive a part of a user's body when strap 10 is being worn across the user's body or on a user body part). Strip 18 may be attached to itself using adhesive to form loop 26 or loop 26 may be formed by attaching a portion of strip 18 to itself at snap mechanism 20 (see, e.g., strip portion 18').

Figure 4:
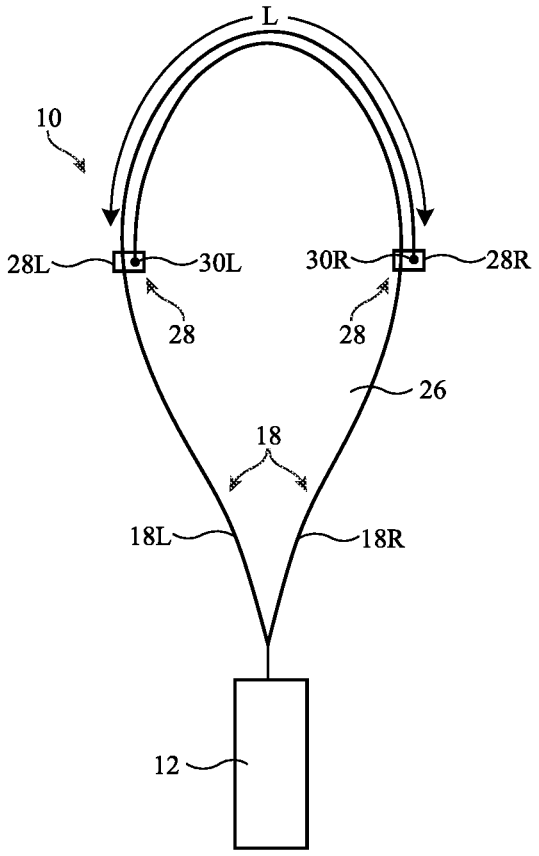
FIG. 4 is a front view of an illustrative adjustable-length strap with a pair of strap sliders in accordance with an embodiment.

Strap 10 may, if desired, have adjustable clasps. The adjustable clasps, which may sometimes be referred to as adjustable sliders or sliding clasps, may allow the length of strap 10 to be adjusted. Consider, as an example, the arrangement of FIG. 4. As shown in FIG. 4, strap 10 may be formed from a looped length of material such as strip 18 forming loop 26. Strip 18 may be coupled to item 12 (e.g., using a removable snap mechanism such as snap mechanism 20 of FIG. 3 or other removable or fixed attachment mechanism). Strip 18 may have a right-hand portion such as right strip 18R and a left hand portion such as left strip 18L. Adjustable clasp mechanisms such as sliders 28 may be used to slidably couple the ends of strips 18R and 18L to portions of strips 18L and 18R, respectively. Each slider 28 may have a slot or other portion that receives a portion of strip 18 for sliding motion. Each slider 28 may also have a fixed attachment to a respective end of strip 18.

In the example of FIG. 4, right strip 18R is slidably received within a slot in slider 28R, which allows slider 28R to slide relative to strip 18R. Similarly, left strip 18L is slidably received within a slot in slider 28L, which allows slider 28L to slide along the length of left strip 18L. The ends of left strip 18L and right strip 18R are attached to sliders 28R and 28L, respectively. As shown in FIG. 4, the end of right strip 18R may be fixedly attached to slider 28L using fixed attachment mechanism 30L (e.g., a pin or other member that is secured to the body of slider 28L). The end of left strip 18R may be fixedly attached to slider 28R using fixed attachment mechanism 30R.

With this arrangement, attachment mechanism 30R holds the end of strip 18L in place on slider 28R, while the slot in slider 28R allows slider 28R to slide along the length of strip 18R. Attachment mechanism 30L holds the end of strip 18R in place on slider 28L, while the slot in slider 28L allows slider 28L to slide along the length of strip 18L. In this way, the separation distance L between sliders 28 along strap 10 may be adjusted. To shorten strap 10, slider 28L and/or slider 28R is moved along strip 18 towards item 12 (e.g., sliders 28 are moved apart to increase L and reduce the size of loop 26). To lengthen strap 10 and increase the size of loop 26, sliders 28 are moved towards each other, which decreases L and increases the size of loop 26. If desired, flexible magnetic structures may be embedded within some or all of strip 18 (e.g., at least in the portion of strip 18 between sliders 28) to help hold strips 18L and 18R next to each other (e.g., to reduce tangling).

As described in connection with FIG. 3, strip 18 may, if desired, have portions adjacent to item 12 that are attached to themselves using a fixed attachment mechanism (e.g., adhesive, stiches, rivets or other fasteners, etc.) to form loop 26. In some configurations, a snap mechanism may be used to hold the ends of strip 18 together to form loop 26 and/or loop 24. In arrangements in which loop 26 is formed by using adhesive to attach strip 18 to itself, loop 24 of FIG. 3 may be formed by using a first snap element on strip 18 (e.g., a male snap) to snap into a second snap element on strip 18 (e.g., a female snap). In arrangements in which loop 26 is formed by snapping part of strip 18 to itself, a three-part snap mechanism may be used.

Figure 5:
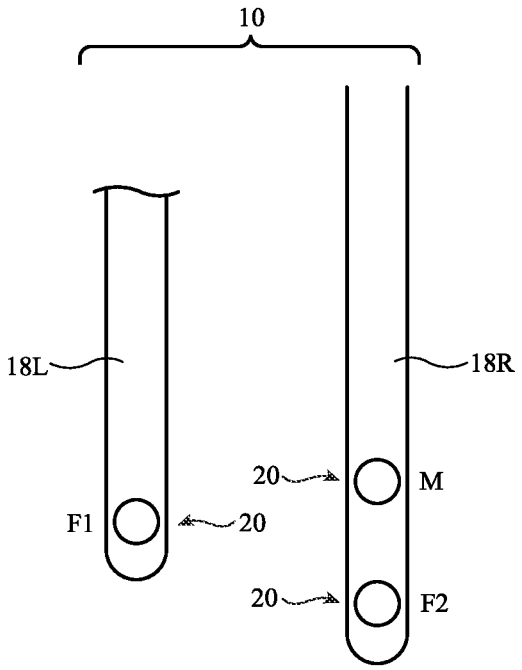
FIG. 5 is a diagram of an illustrative unassembled three-part snap mechanism for a strap in accordance with an embodiment.
Figure 6:
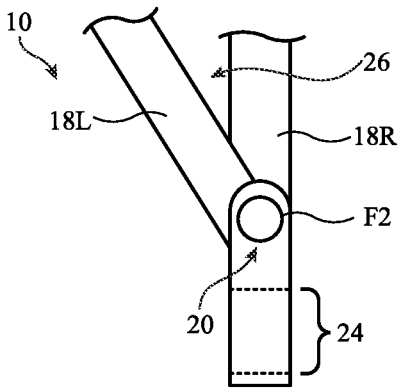
FIG. 6 is a diagram of the illustrative three-part snap mechanism of FIG. 5 in an assembled configuration in accordance with an embodiment.

An illustrative three-element snap mechanism is shown in FIGS. 5 and 6. Snap mechanism 20 of FIG. 5 is shown in its unassembled state. This type of mechanism may be used, for example, to secure item 12 of FIG. 4 to strap 10 of FIG. 4. As shown in FIG. 4, a first snap element (e.g., a female snap member such as female snap F1) may be attached to an end of left strip 18L and second and third snap elements (e.g., female snap F2 and male snap M) may be attached to an end of right strip 18R. In the assembled state of FIG. 6, strip 18R folds back on itself to form loop 24 and snap F1 is snapped into place between snap F2 and snap M, thereby attaching the lower end of left strip 18L to the lower end of right strip 18L to form loop 26. Item body 12B may have a portion that passes through loop 24. The three coupled snaps of snap mechanism 20 allow snap F1 to rotate relative to snaps M and F2, so that the angle between strips 18L and 18R may be adjusted by the user (e.g., so that strap 10 lies comfortably against the user's body).

Figure 7:
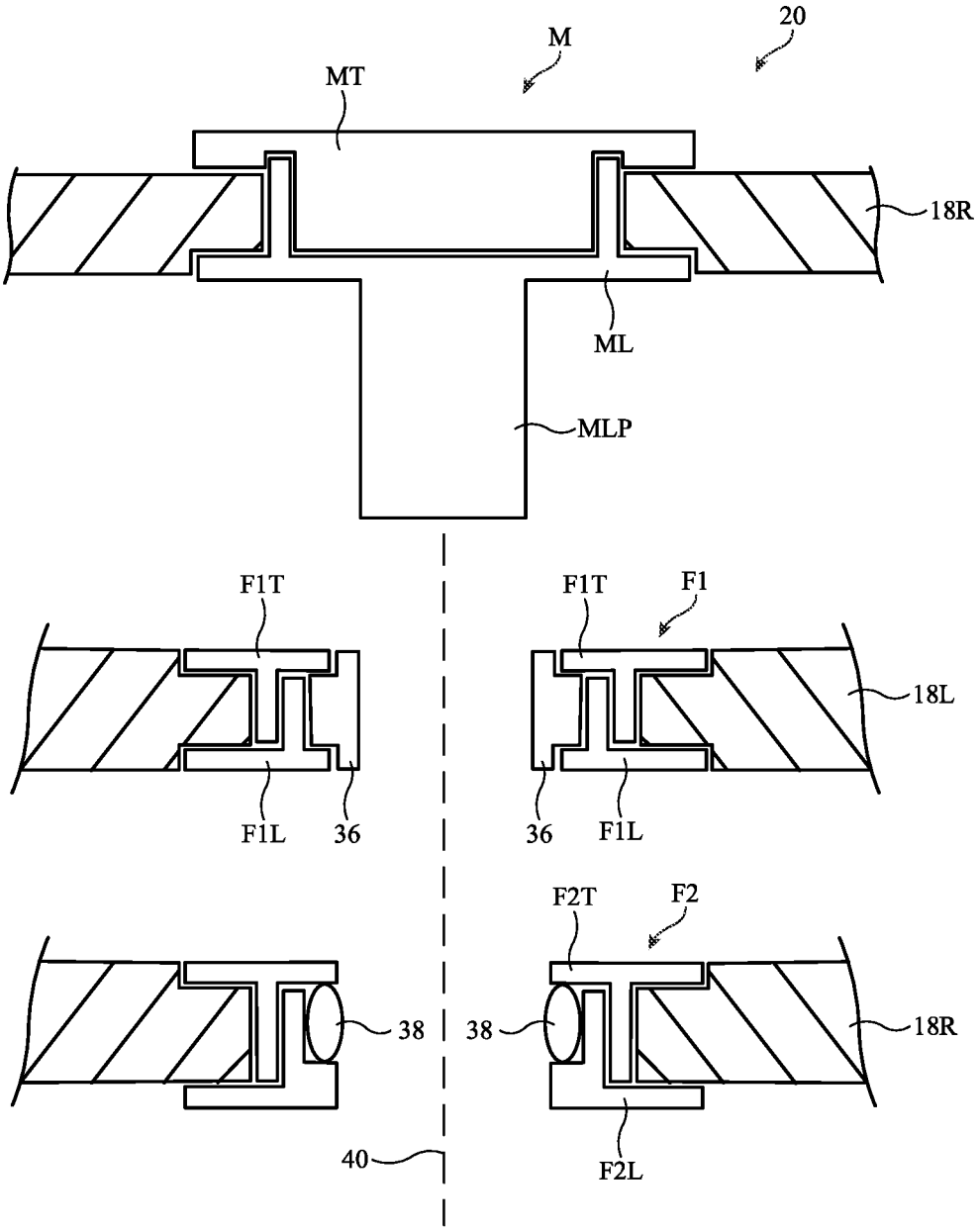
FIG. 7 is a cross-sectional side view of an illustrative strap snap mechanism with a male snap and two female snaps in accordance with an embodiment.

FIG. 7 is an exploded cross-sectional side view of a three-element snap mechanism such as snap mechanism 20 of FIGS. 5 and 6. In this example, male snap M has first portion MT and second portion ML. These portions pass through an opening in strip 18R and may be attached to each other using a press-fit connection. In this way snap M captures a portion of strip 18R and is fixedly attached to strip 18R. Protrusion MLP (e.g., a cylindrical post) of snap portion ML of snap M snaps into corresponding openings in snaps F1 and F2 when snapping together snaps M, F1, and F2.

The middle snap in mechanism 20 (snap F1) has first portion FIT and second portion FIL, which are press fit together in an opening in strip 18L to attach snap F1 to strip 18L. A ring member such as polymer ring 36 may be mounted in the center of snap F1 to help reduce binding and/or rattling between snap F1 and the other snaps of mechanism 20 so that snap F1 may smoothly and quietly rotate relative to protrusion MLP. Snap F2 has first portion F2T and second portion F2L, which are press-fit together to secure snap F2 within an opening in strip 18L. The openings in snaps F1 and F2 receive protrusion MLP of snap M along axis 40 when it is desired to close snap mechanism 20 by snapping together snaps M, F1, and F2. Ring-shaped member 38 in snap F2 (e.g., a ring of metal, polymer, etc.) may be used to create friction with protrusion MLP, thereby helping to hold snap mechanism 20 in its closed position.

Figure 8:
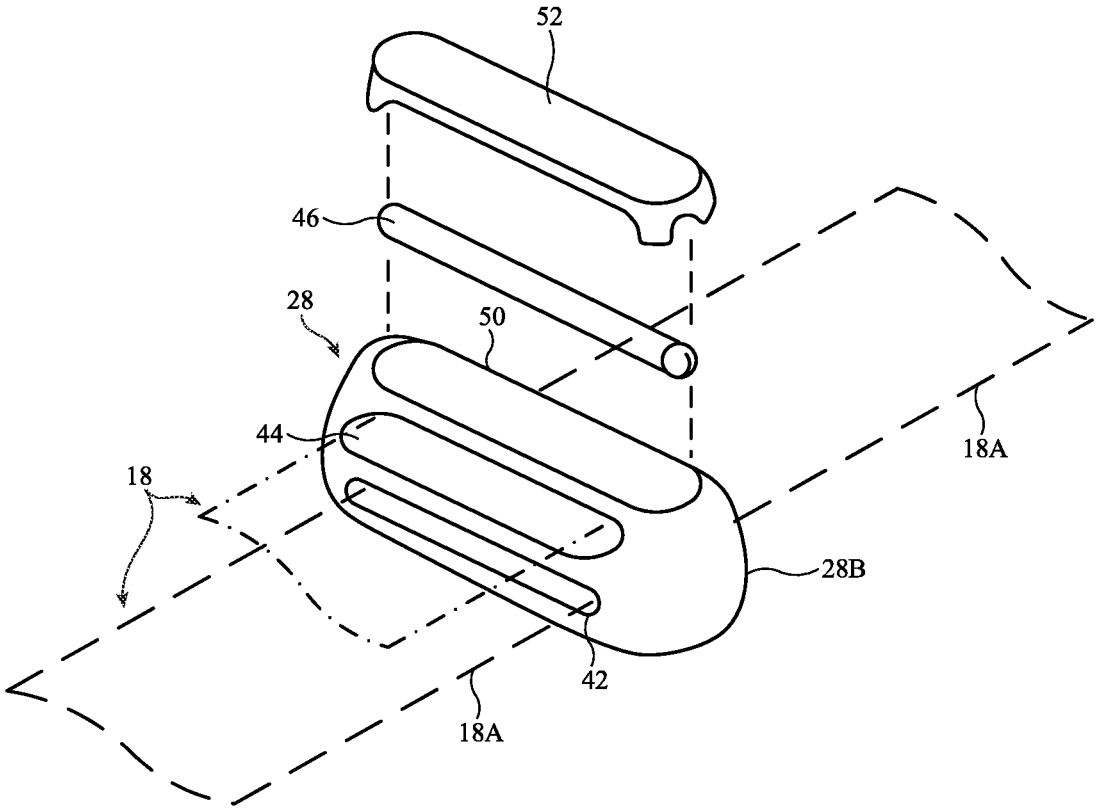
FIG. 8 is an exploded perspective view of an illustrative slider for a strap in accordance with an embodiment.

Sliders 28 may be formed from one or more structures joined together using press-fit connections, adhesive, fasteners, welds, and/or other attachment mechanisms. An exploded perspective view of an illustrative slider 28 is shown in FIG. 8. In the example of FIG. 8, slider 28 has main slider body 28B. Body 28B and the other structures of slider 28 may be formed from metal, polymer, other materials, and/or combinations of these materials.

Body 28B has a through-hole opening such as though slot 42 that receives a portion of strip 18 (e.g., portion 18A) for sliding motion (e.g., slot 42 receives strip portion 18A while allowing that portion of strip 18 to slide with respect to slider 28). Slider 28 may be configured to provide friction in slot 42 so that slider 28 is maintained in place on strip 18 until deliberately moved by a user to adjust the length of strap 10.

Body 28B also has a non-through-hole opening such as slot 44. The end of a portion of strip 18 such as portion 18B may pass through slot 44. A loop or other structure in the end portion of strip 18 that passes through slot 44 into the interior of body 28B may receive a strip retention member such as strip retention pin 46. Pin 46 may be mounted into recesses in body 28B or other pin retention structures in the interior of body 28B through opening 50 in body 28B. Cap 52 may then be press fit into opening 50 to cover opening 50 and thereby close body 28B. With this type of arrangement, pin 46 and the corresponding loop at the end of strip portion 18A form a fixed slider attachment mechanism (see, e.g., attachment mechanisms 30L and 30R of FIG. 4). Slot 42 allows sliding motion between slider 28 and strip 18 to adjust the length of strap 10.

Figure 9:
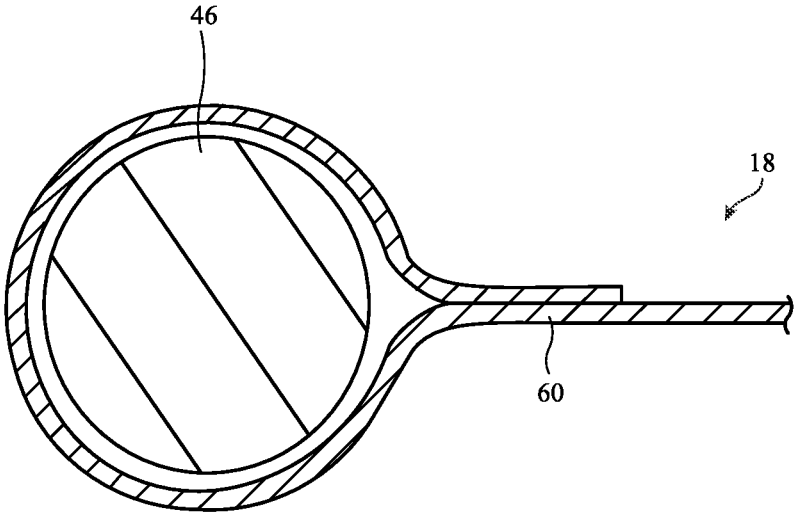
FIG. 9 is a cross-sectional side view of an illustrative looped strap layer that has captured a strap slider pin in accordance with an embodiment.

Strip 18 may include one or more layers (sometimes referred to as strip-shaped layers, strips, elongated layers, strip layers, band layers, strap layers, etc.). These layers are used in providing strip 18 with desired properties. As an example, strip 18 may have a strengthening layer such as strengthening layer 60 (e.g., a layer of fabric, polymer, etc.) that is looped around pin 46 to fixedly attach strip 18 to pin 46 as shown in FIG. 9. Layer 60 may be attached to itself and/or other layers in strip 18 using adhesive, fastener(s), fusion under heat and/or pressure, etc.

Figure 10:
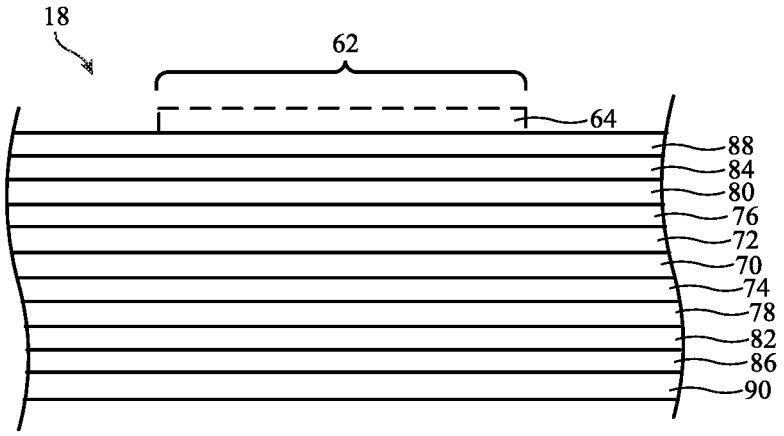
FIG. 10 is a cross-sectional side view of a portion of an illustrative strap in accordance with an embodiment.

As shown in FIG. 10, multiple layers of material may be stacked with each other to form one or more portions of strip 18. Strip 18 may have the same sets of layers along its entire length or different portions of strip 18 may have different sets of layers. As an example, one or more portions of strip 18 such as illustrative segment 62 may be covered with an external layer such as layer 64. Layer 64 may be, for example, a polymer layer that creates a smooth texture-free surface on an underlying fabric layer so that sliders 28 can slide smoothly and quietly along strip 18).

The layers of material forming strip 18 may include fabric layers (e.g., thin sheets of fabric and/or fabric loops that are folded to form doubled-up fabric layers), polymer layers, layers of thin bendable metal, layers with magnetic material (e.g., magnetic particles embedded in flexible polymer binder to form a flexible magnet such as an elongated strip-shaped flexible magnet), adhesive layers, composite materials (e.g., polymer binder with embedded flexible strands of material such as polymer yarn, fiber glass strands, metal strands, etc.), layers formed form natural materials such as cotton, leather, wool, bamboo, and/or other natural materials, and/or layers of other materials, and/or combinations of these materials. In some configurations, the outermost layers of material on strip 18 (e.g. layers on the upper and lower opposing surfaces of strip 18) may be formed from materials that resist wear and/or have a desired cosmetic appearance. As an example, some or all of the outermost layers of strip 18 may be formed from materials such as leather, fabric, and/or polymer.

If desired, a magnetic layer may be included in the layers of strip 18. Magnetic layers (e.g., magnets) may attract one portion of strip 18 to another. For example, an elongated strip-shaped flexible magnet may be embedded in the core of strip 18 so that overlapping portions of strip 18 (e.g., strips 18R and 18L of FIG. 4) that are located between sliders 28 attract each other. Each overlapping strip portion may have a respective flexible magnetic strip or a magnetic strip may be formed in one strip portion and a flexible layer of non-magnetized magnetic material that is attracted by the magnet may be provided in another strip portion. By magnetically attaching strips 18R and 18L to each other in this way, strip 18 may be provided with attractive appearance and excess movement of overlapping portions of strip 18 with respect to each other can be avoided. At the same time, magnetic attraction between the strip portions may be limited, so that strips 18R and 18L are allowed to shift position relative to each other when desired to adjust the length of strap 10.

In general, any suitable layers may be included in strip 18 (e.g., magnetic layers, strengthening layers, layers that adjust the stiffness of strip 18, layers of adhesive to attach other layers together, layers to adjust strap thickness and/or weight, etc.). In the illustrative configuration of FIG. 10, strip 18 includes a flexible magnet (flexible magnetic layer 70) that is sandwiched between upper polymer layer 72 and a lower polymer layer 74. Layers 72 and 74 may be formed from elastomeric polymer material such as silicone or thermoplastic polyurethane (as examples) that is flexible and helps provide strip 18 with desired mechanical attributes (e.g., bendability, weight, thickness, etc.). Layers 80 and 82 may be, for example, strengthening layers formed from elongated strips of polymer film and/or fabric. Layer 80 may be attached to layer 72 using adhesive layer 76. Layer 82 may be attached to layer 74 using adhesive layer 78. Outer strip layers such as layers 88 and/or 90 may be leather, fabric, polymer sheets, and/or other layers of material. Layer 88 may be attached to layer 80 with adhesive layer 84. Layer 90 may be attached to layer 82 with adhesive layer 86.

The layers used in forming illustrative strip 18 of FIG. 10 are illustrative. Additional layers and/or fewer layers may be provided, if desired. For example, along some or all of the length of strip 18, flexible magnet 70 may be omitted or may be replaced by a non-magnetized layer of magnetic material. Additional strengthening layers or fewer strengthening layers may be provided. Adhesive layers may be omitted (e.g., when polymer layers are formed by coating polymer onto other layers). The cosmetic outer layers of strip 18 may be formed from fabric tubes, coatings, and/or other structures. The arrangement of FIG. 10 is an example.

Figure 11:
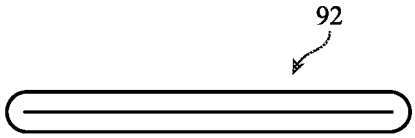
FIG. 11 is a cross-sectional end view of an illustrative fabric tube that may be used in forming one or more strap layers in accordance with an embodiment.
Figure 12:
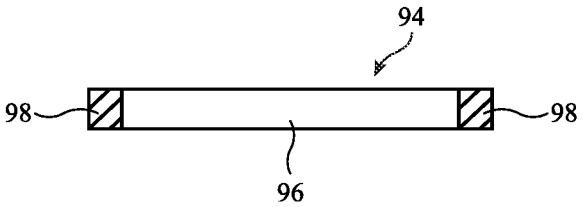
FIG. 12 is a cross-sectional end view of an illustrative leather layer that may be used in forming one or more strap layers in accordance with an embodiment.

If desired, one or more of the layers of strip 18 may include fabric. A strip-shaped sheet of fabric may be provided. If desired, a woven, knit, or braided tube of fabric may be used in forming one or more layers in strip 18. For example, layer 88 and/or layer 90 may each be formed by a collapsed tube of fabric such as fabric tube 92 of FIG. 11. The fabric tube of FIG. 11 has two sublayers (corresponding to the two opposing sides of the tube prior to flattening the tube) and has attractive (uncut) edges, which may enhance the appearance of strip 18. A layer of adhesive may be included in the middle of the tube to help hold the collapsed sides of the tube together. As shown in the example of FIG. 12, layer 94 (which may be used, for example, to form outer layer(s) in strip 18 such as layer 88 and/or layer 90) may include a leather strip such as strip 96 with painted edge portion 98.

Figure 13:
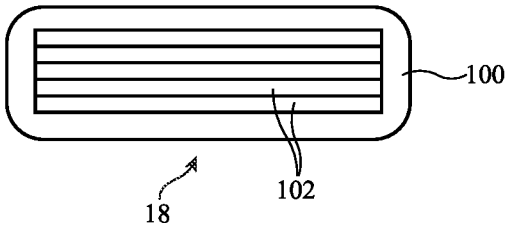
FIG. 13 is a cross-sectional end view of an illustrative strap having layers embedded within the interior of a fabric tube in accordance with an embodiment.

In some embodiments, a tube of fabric may be used to enclose other layers of material for strip 18. This type of arrangement is shown in FIG. 13. In the example of FIG. 13, strip 18 has a tube of fabric such as fabric tube 100 that forms the outer surfaces of strip 18, including the opposing upper and lower surfaces of strip 18 and the outer sidewalls portions of strip 18. One or more interior layers 102 (e.g., a flexible magnet, strengthening layers, elastomeric polymer layers, adhesive layers, etc.) may be formed in the interior of tube 100.

Figure 14:
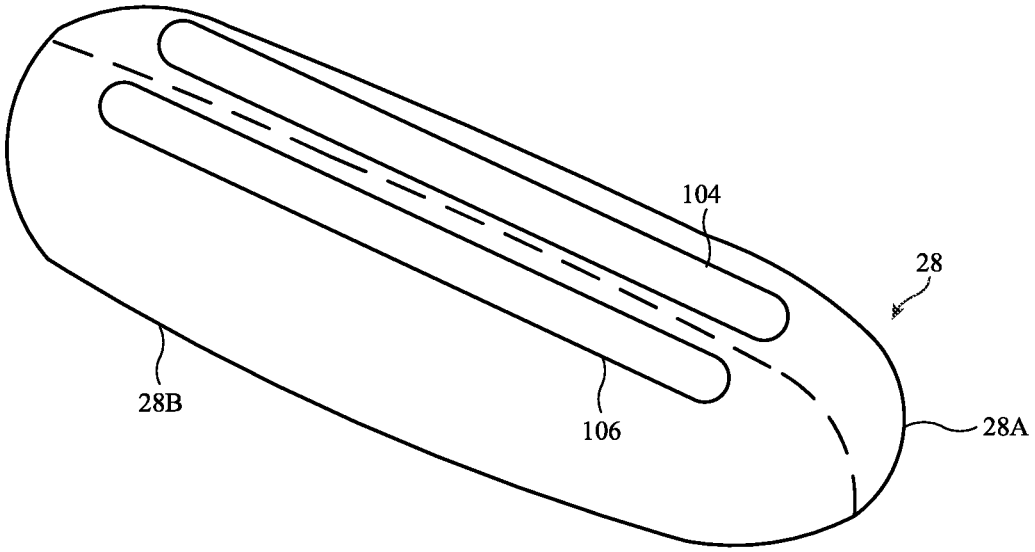
FIG. 14 is a perspective view of an illustrative strap slider for an adjustable-length strap in accordance with an embodiment.

Sliders 28 may be formed from one or more structures that are press fit together and/or are otherwise joined. In the example of FIG. 14, slider 28 is formed from mating halves such as first half member 28A and second half member 28B. Member 28A may have a through slot such as slot 104 that receives strip 18 for sliding motion. Member 28 may have a partial slot such as slot 106 that receives the fixed end of strip 18.

Figure 15:
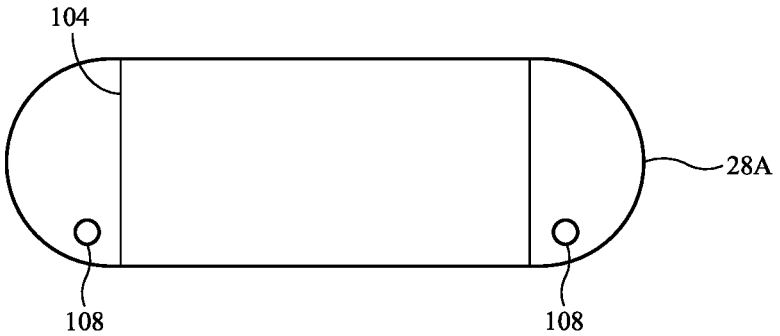
FIGS. 15 and 16 are cross-sectional views of illustrative portions of the strap slider of FIG. 14 in accordance with an embodiment.

As shown in the cross-sectional side view of member 28A of FIG. 15, slot 104 may pass from one side of member 28A to the other. Engagement structures 108 on member 28A (e.g., protruding pins and/or recesses) may be press fit into corresponding engagement structures 108 on member 28B (FIG. 16).

Figure 16:
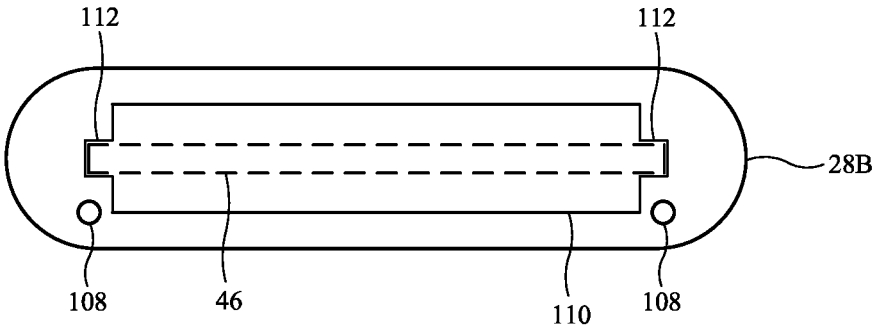

As shown in FIG. 16, member 28B may have an internal cavity such as cavity 110 that receives the looped end of strip 18 and that has recesses 112 to hold the ends of pin 46.

Figure 17:
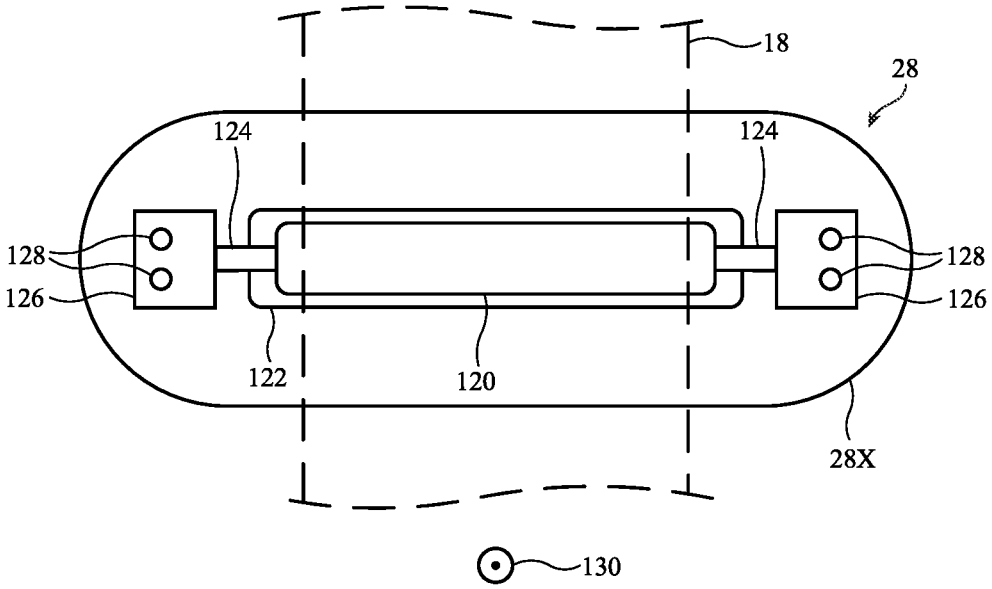
FIG. 17 is a cross-sectional view of an illustrative strap slider with a spring-based strap friction mechanism in accordance with an embodiment.

In the illustrative configuration for slider 28 that is shown in FIG. 17, slider body 28X includes rotating bar 120 in internal cavity 122. A through-slot passes by cavity 122 and allows strip 18 to slide relative to slider body 28X when not engaged by bar 120. Bar 120 may be mounted for rotation on axle 124. Axle 124 may have ends received in axle holders 126. Holders 126 may be biased along axis 130 (a direction that is out of the page in the orientation of FIG. 17) by springs 128. This presses bar 120 against strip 18. Bar 120 may have an oblong cross-sectional shape that can disengage from strip 18 (to allow strip 18 to slide) or that can (by rotation) engage strip 18 (e.g., to help create sufficient friction to hold slider 28 in a desired position on strip 18). Because a spring mechanism is used in creating friction for strip 18 in the arrangement of FIG. 17, this type of arrangement may sometimes be referred to as having a spring-based friction mechanism or active strap friction.

Figure 18:
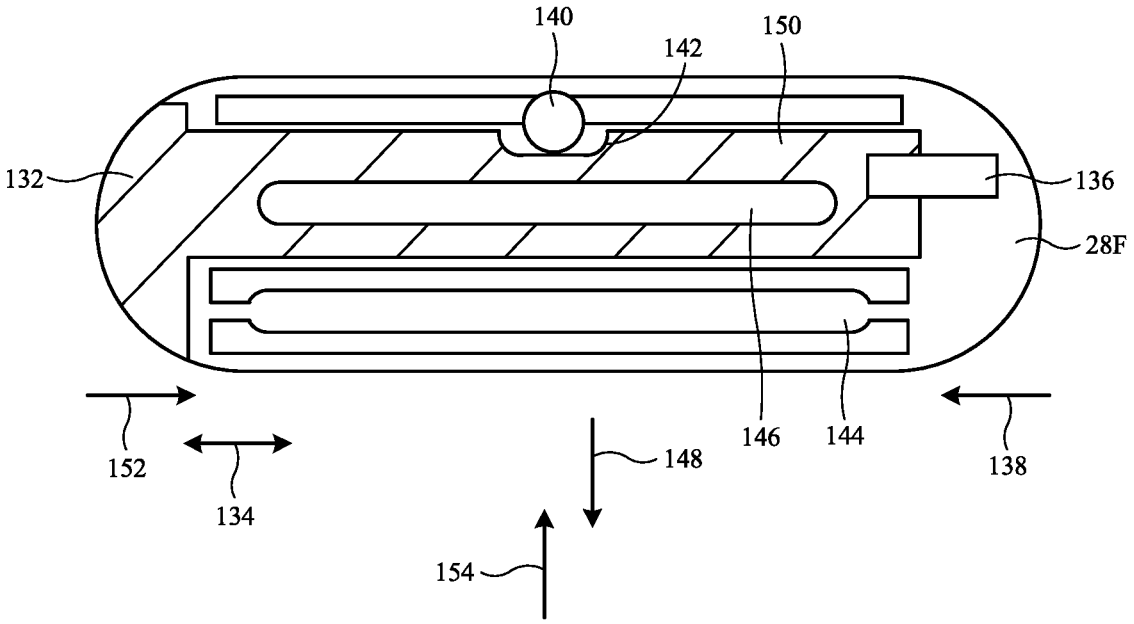
FIG. 18 is a cross-sectional view of an illustrative strap slider with a cam mechanism for providing strap friction in accordance with an embodiment.

FIG. 18 is a cross-sectional view of slider 28 in an illustrative arrangement in which a spring-based cam mechanism is used in creating active friction. As shown in FIG. 18, slider 28 of FIG. 18 may have a slider body 28F. Sliding button member 130 may move along axis 134 within body 28F. Strip 18 may have a loop that captures a pin that is received within recess 144 to fixedly attach an end of strip 18 to body 28F. Strip 18 may also have a portion that is received within strip opening 146 for sliding motion relative to slider 28.

Spring 136 may press button member 132 in direction 138. This causes cam surface 142 of member 132 to bear against pin 140, forcing portion 150 of member 132 in direction 148 and thereby squeezing slot 146 about the strip in slot 146. This holds slider 28 in place against strip 18. When it is desired to release strip 18 from slot 146, a user may press button 132 in direction 152, which relieves cam pressure from portion 150 and allows portion 150 to move in direction 154, thereby reducing friction on strip 18.

Figure 19:
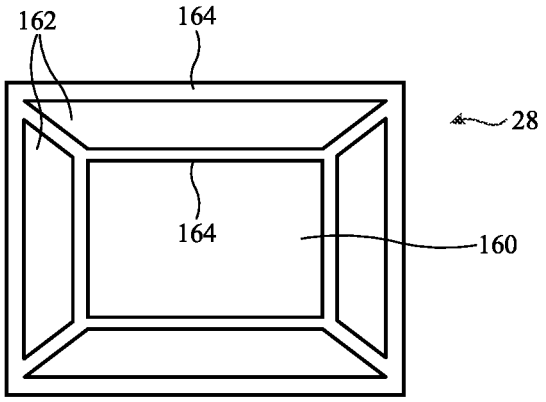
FIGS. 19 and 20 are cross-sectional views of an illustrative strap slider mechanism based on a flexible box structure that buckles in accordance with an embodiment.
Figure 20:
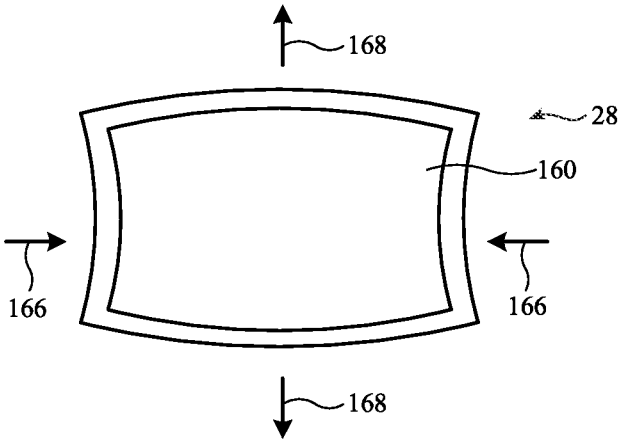

FIG. 19 is a cross-sectional side view of a portion of an illustrative adjustable slot for slider 28 based on deformable structures. Deformable members 162 (e.g., foam pads, elastomeric members, spring structures, and/or other deformable structures) may be enclosed in supporting structures 164 (e.g., fabric layers, polymer layers, and/or other housing structures for slider 28). Strip 18 may pass through slot 160. Friction from the upper and lower surfaces of slot 160 may help hold strip 18 in place when slider 28 is not being adjusted. When it is desired to change the length of strap 10, a user may squeeze inwardly in directions 166 on the sides of slider 28 as shown in FIG. 20. This causes slot 160 to buckle in directions 168 and thereby reduce pressure and friction on strip 18 in slot 160 so that slider 28 can be moved along the length of strip 18.

Figure 21:
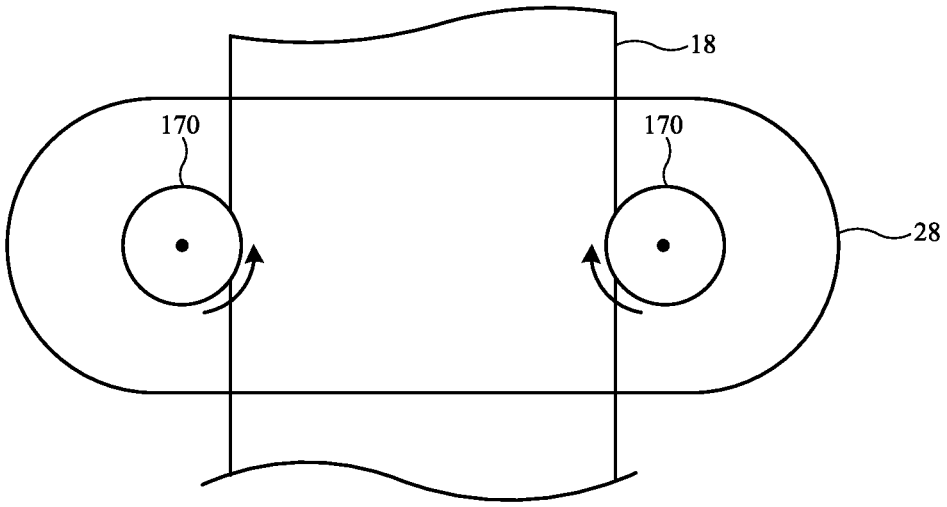
FIGS. 21 and 22 are views of a portion of an illustrative strap slider with rotating strap engagement wheels in accordance with an embodiment.

In the illustrative configuration of FIG. 21, slider 28 has rotating strip guide wheels 170 on opposing edges of strip 18. As shown in the side view of FIG. 22, wheels 170 may hold strip 18 in place vertically while allowing strip 18 to slide through slider 28 when adjusting the length of strap 10. The presence of wheels 170 may help reduce friction on edge portions 172 of strip 18, which may be covered with paint or other material that could be subject to undesired amounts of wear in the absence of wheels 170.

Figure 22:
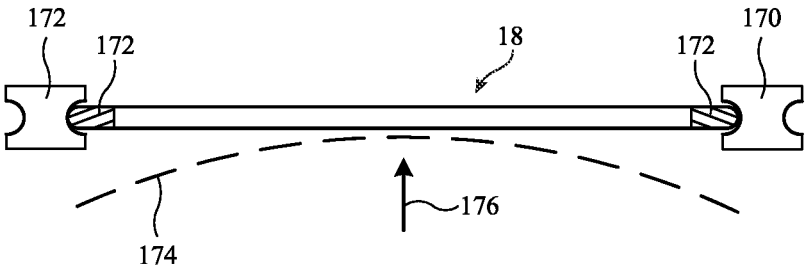

Slider 28 may, if desired, include biasing structures such as spring 174. In the example of FIG. 22, spring 174 is being used to press strip 18 upwards (e.g., against an opposing surface of a slot in slider 28), thereby creating a desired amount of holding friction so that slider 28 does not slide unexpectedly during use. Biasing structures such as spring 174 may include leaf springs, coil springs, torsion springs, springs formed from compressed foam, or other biasing structures.

Figure 23:
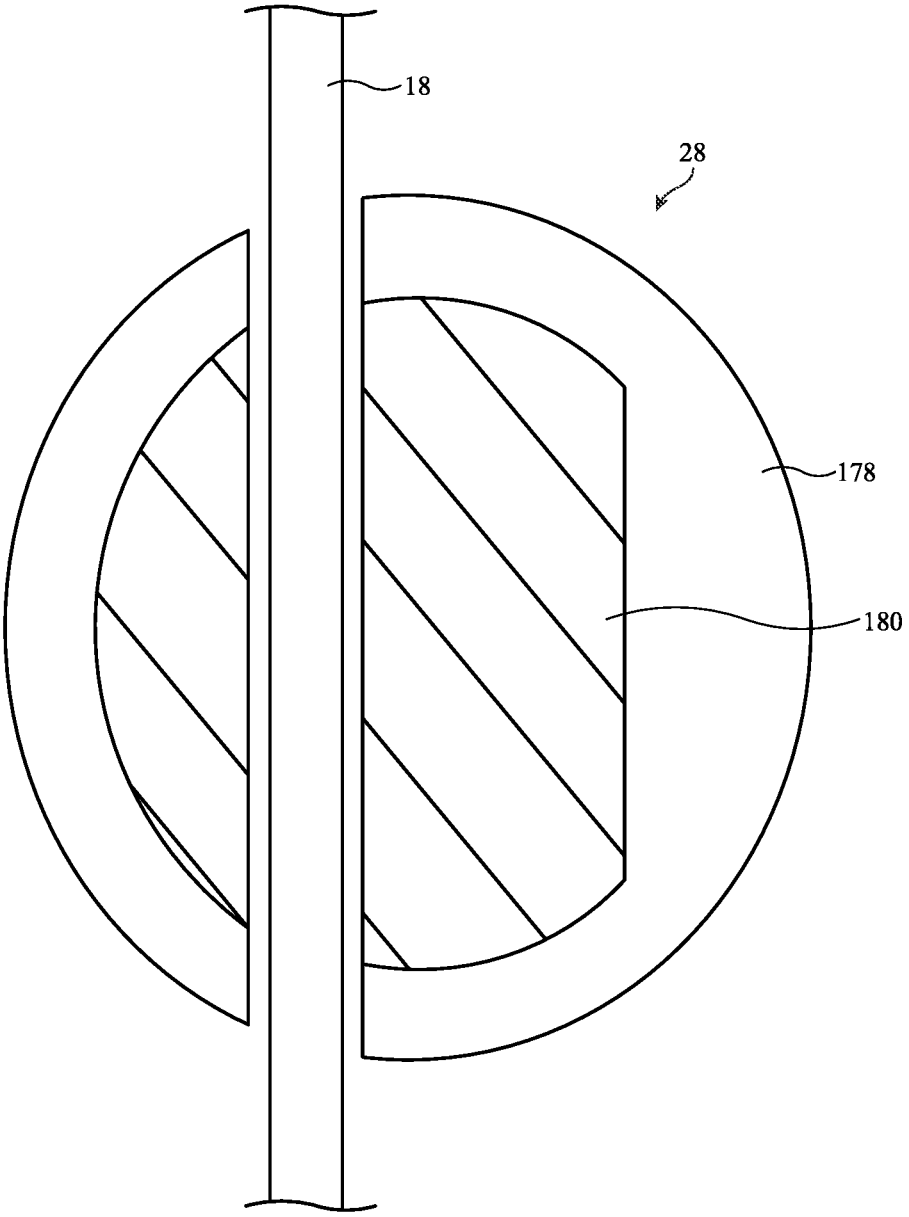
FIG. 23 is a cross-sectional view of an illustrative strap slider with a core embedded in a shell in accordance with an embodiment.

In some embodiments, slider 28 may be formed from an outer shell that is filled with polymer or other filler material that forms a core for the shell. As shown in FIG. 23, for example, slider 28 may have outer shell 178 (e.g., a metal housing with relatively thin housing walls) and an inner filler material such as injection molded polymer 180 that forms a core within shell 178. A slot may be formed in slider 28 for receiving strip 18. The slot may have portions that pass through portions of shell 178 and portions of molded polymer 180. The presence of polymer 180 may provide the slot with a desired amount of friction while strip 18 slides through the slot.

Figure 24:
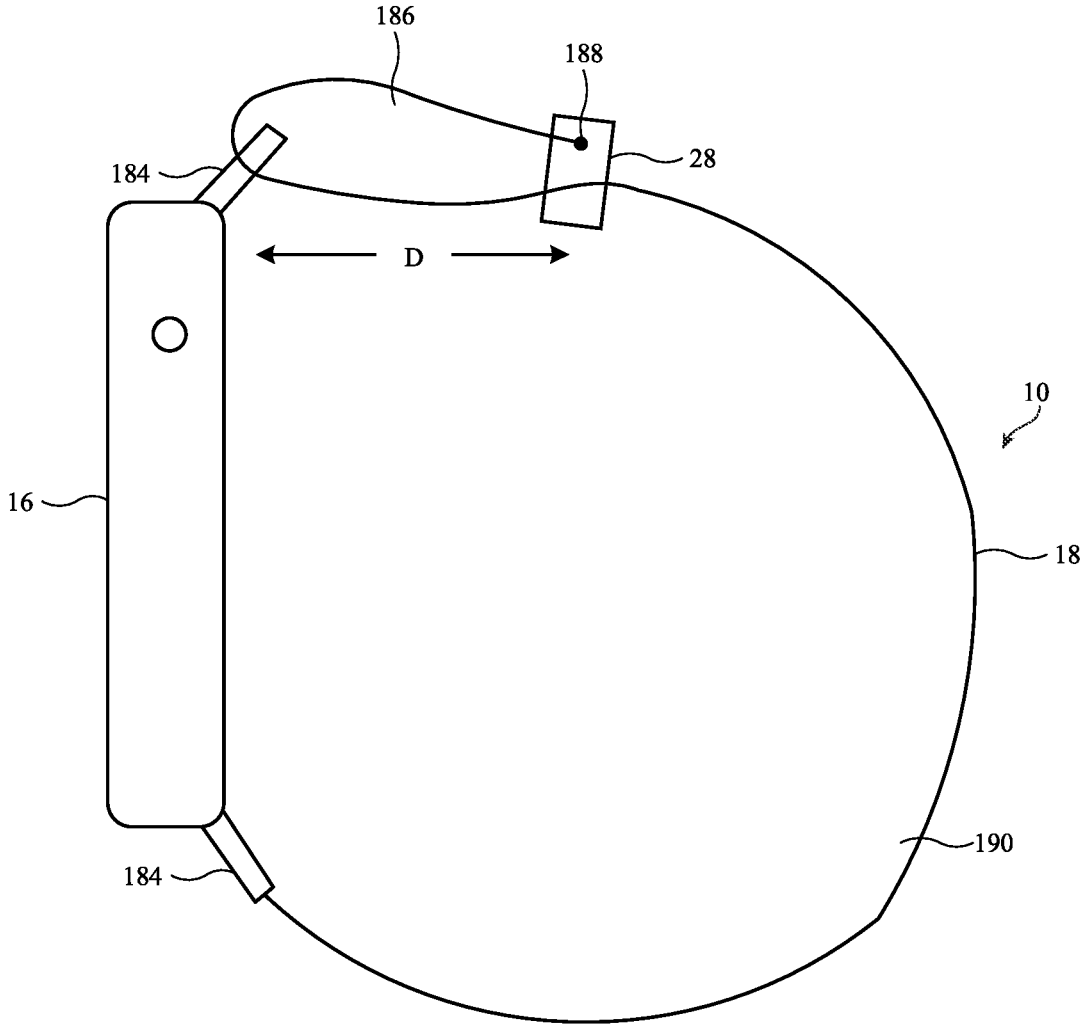
FIG. 24 is a side view of an illustrative electronic device with a wrist strap in accordance with an embodiment.

If desired, strap 10 may be coupled to items that are worn on a user's wrist or other body part. Consider, as an example, the illustrative configuration of FIG. 24. As shown in FIG. 24, a wristwatch or other electronic device 16 may be coupled to strap 10. Strap 10 may be an adjustable-length wrist strap configured to be worn on a wrist of a user. Strap 10 may have a strip of material such as strip 18 that is configured to form a wrist-sized loop such as loop 190. Strap 10 may be coupled to device 16 using coupling structures 184 (e.g., lugs and spring bars and/or other coupling structures).

One end of strip 18 may be provided with an adjustable-length loop such as loop 186. The tip of strip 18 at this end of strip 18 may be fixedly attached to slider 28 at fixed attachment point 188. Slider 28 may have a slot that allows slider 28 to slide along the length of strip 18. When a user desires to adjust the size of loop 190 (e.g., to loosen or tighten strap 10 so that strap 10 and device 16 may fit comfortably on the user's wrist), slider 28 may be moved towards device 16 or away from device 16 to adjust the separation distance D between slider 28 and device 16 and thereby adjust the size of loop 186 and the length of strap 10.

As described above, one aspect of the present technology is the gathering and use of information such as information from input-output devices. The present disclosure contemplates that in some instances, data may be gathered that includes personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, username, password, biometric information, or any other identifying or personal information.

The present disclosure recognizes that the use of such personal information, in the present technology, can be used to the benefit of users. For example, the personal information data can be used to deliver targeted content that is of greater interest to the user. Accordingly, use of such personal information data enables users to have control of the delivered content. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the United States, collection of or access to certain health data may be governed by federal and/or state laws, such as the Health Insurance Portability and Accountability Act (HIPAA), whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, the present technology can be configured to allow users to select to "opt in" or "opt out" of participation in the collection of personal information data during registration for services or anytime thereafter. In another example, users can select not to provide certain types of user data. In yet another example, users can select to limit the length of time user-specific data is maintained. In addition to providing "opt in" and "opt out" options, the present disclosure contemplates providing notifications relating to the access or use of personal information. For instance, a user may be notified upon downloading an application ("app") that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data at a city level rather than at an address level), controlling how data is stored (e.g., aggregating data across users), and/or other methods.

Therefore, although the present disclosure broadly covers use of information that may include personal information data to implement one or more various disclosed embodiments, the present disclosure also contemplates that the various embodiments can also be implemented without the need for accessing personal information data. That is, the various embodiments of the present technology are not rendered inoperable due to the lack of all or a portion of such personal information data.

Physical environment: A physical environment refers to a physical world that people can sense and/or interact with without aid of electronic systems. Physical environments, such as a physical park, include physical articles, such as physical trees, physical buildings, and physical people. People can directly sense and/or interact with the physical environment, such as through sight, touch, hearing, taste, and smell.

Computer-generated reality: in contrast, a computer-generated reality (CGR) environment refers to a wholly or partially simulated environment that people sense and/or interact with via an electronic system. In CGR, a subset of a person's physical motions, or representations thereof, are tracked, and, in response, one or more characteristics of one or more virtual objects simulated in the CGR environment are adjusted in a manner that comports with at least one law of physics. For example, a CGR system may detect a person's head turning and, in response, adjust graphical content and an acoustic field presented to the person in a manner similar to how such views and sounds would change in a physical environment. In some situations (e.g., for accessibility reasons), adjustments to characteristic(s) of virtual object(s) in a CGR environment may be made in response to representations of physical motions (e.g., vocal commands). A person may sense and/or interact with a CGR object using any one of their senses, including sight, sound, touch, taste, and smell. For example, a person may sense and/or interact with audio objects that create 3D or spatial audio environment that provides the perception of point audio sources in 3D space. In another example, audio objects may enable audio transparency, which selectively incorporates ambient sounds from the physical environment with or without computer-generated audio. In some CGR environments, a person may sense and/or interact only with audio objects. Examples of CGR include virtual reality and mixed reality.

Virtual reality: A virtual reality (VR) environment refers to a simulated environment that is designed to be based entirely on computer-generated sensory inputs for one or more senses. A VR environment comprises a plurality of virtual objects with which a person may sense and/or interact. For example, computer-generated imagery of trees, buildings, and avatars representing people are examples of virtual objects. A person may sense and/or interact with virtual objects in the VR environment through a simulation of the person's presence within the computer-generated environment, and/or through a simulation of a subset of the person's physical movements within the computer-generated environment.

Mixed reality: In contrast to a VR environment, which is designed to be based entirely on computer-generated sensory inputs, a mixed reality (MR) environment refers to a simulated environment that is designed to incorporate sensory inputs from the physical environment, or a representation thereof, in addition to including computer-generated sensory inputs (e.g., virtual objects). On a virtuality continuum, a mixed reality environment is anywhere between, but not including, a wholly physical environment at one end and virtual reality environment at the other end. In some MR environments, computer-generated sensory inputs may respond to changes in sensory inputs from the physical environment. Also, some electronic systems for presenting an MR environment may track location and/or orientation with respect to the physical environment to enable virtual objects to interact with real objects (that is, physical articles from the physical environment or representations thereof). For example, a system may account for movements so that a virtual tree appears stationery with respect to the physical ground. Examples of mixed realities include augmented reality and augmented virtuality. Augmented reality: an augmented reality (AR) environment refers to a simulated environment in which one or more virtual objects are superimposed over a physical environment, or a representation thereof. For example, an electronic system for presenting an AR environment may have a transparent or translucent display through which a person may directly view the physical environment. The system may be configured to present virtual objects on the transparent or translucent display, so that a person, using the system, perceives the virtual objects superimposed over the physical environment. Alternatively, a system may have an opaque display and one or more imaging sensors that capture images or video of the physical environment, which are representations of the physical environment. The system composites the images or video with virtual objects, and presents the composition on the opaque display. A person, using the system, indirectly views the physical environment by way of the images or video of the physical environment, and perceives the virtual objects superimposed over the physical environment. As used herein, a video of the physical environment shown on an opaque display is called "pass-through video," meaning a system uses one or more image sensor(s) to capture images of the physical environment, and uses those images in presenting the AR environment on the opaque display. Further alternatively, a system may have a projection system that projects virtual objects into the physical environment, for example, as a hologram or on a physical surface, so that a person, using the system, perceives the virtual objects superimposed over the physical environment. An augmented reality environment also refers to a simulated environment in which a representation of a physical environment is transformed by computer-generated sensory information. For example, in providing pass-through video, a system may transform one or more sensor images to impose a select perspective (e.g., viewpoint) different than the perspective captured by the imaging sensors. As another example, a representation of a physical environment may be transformed by graphically modifying (e.g., enlarging) portions thereof, such that the modified portion may be representative but not photorealistic versions of the originally captured images. As a further example, a representation of a physical environment may be transformed by graphically eliminating or obfuscating portions thereof. Augmented virtuality: an augmented virtuality (AV) environment refers to a simulated environment in which a virtual or computer generated environment incorporates one or more sensory inputs from the physical environment. The sensory inputs may be representations of one or more characteristics of the physical environment. For example, an AV park may have virtual trees and virtual buildings, but people with faces photorealistically reproduced from images taken of physical people. As another example, a virtual object may adopt a shape or color of a physical article imaged by one or more imaging sensors. As a further example, a virtual object may adopt shadows consistent with the position of the sun in the physical environment.

Hardware: there are many different types of electronic systems that enable a person to sense and/or interact with various CGR environments. Examples include head mounted systems, projection-based systems, heads-up displays (HUDs), vehicle windshields having integrated display capability, windows having integrated display capability, displays formed as lenses designed to be placed on a person's eyes (e.g., similar to contact lenses), headphones/earphones, speaker arrays, input systems (e.g., wearable or handheld controllers with or without haptic feedback), smartphones, tablets, and desktop/laptop computers. A head mounted system may have one or more speaker(s) and an integrated opaque display. Alternatively, a head mounted system may be configured to accept an external opaque display (e.g., a smartphone). The head mounted system may incorporate one or more imaging sensors to capture images or video of the physical environment, and/or one or more microphones to capture audio of the physical environment. Rather than an opaque display, a head mounted system may have a transparent or translucent display. The transparent or translucent display may have a medium through which light representative of images is directed to a person's eyes. The display may utilize digital light projection, OLEDs, LEDs, uLEDs, liquid crystal on silicon, laser scanning light sources, or any combination of these technologies. The medium may be an optical waveguide, a hologram medium, an optical combiner, an optical reflector, or any combination thereof. In one embodiment, the transparent or translucent display may be configured to become opaque selectively. Projection-based systems may employ retinal projection technology that projects graphical images onto a person's retina. Projection systems also may be configured to project virtual objects into the physical environment, for example, as a hologram or on a physical surface.

The foregoing is merely illustrative and various modifications can be made to the described embodiments. The foregoing embodiments may be implemented individually or in any combination.

What is claimed is:

1. A strap configured to removably couple to an item, comprising:

a strip of material configured to form a first loop that couples the strap to the item and configured to form a second loop; and a three-part snap mechanism having a first snap coupled to a first portion of the strip, a second snap coupled to a second portion of the strip, and a third snap coupled to the second portion of the strip, wherein the first, second, and third snaps are configured to snap together, the first snap is between the third snap and the second snap when the first, second, and third snaps are snapped together, the third snap comprises a protrusion, and the first and second snaps comprise respective first and second openings configured to receive the protrusion.

2. The strap defined in claim 1 further comprising a slider configured to slide along the strip of material, wherein the slider includes a pin and wherein the strip comprises:

a first outer layer and a second outer layer;

a flexible magnet between the first and second outer layers; and a layer of material that forms a loop around the pin to fixedly attach the strip to the slider.

3. The strap defined in claim 1 further comprising a slider having a slot through which the strip passes.

4. The strap defined in claim 3 wherein the slider comprises a rotating bar configured to press against a portion of the strip passing through the slot.

5. The strap defined in claim 3 wherein the slider comprises a button member and a spring configured to press against the button member.

6. The strap defined in claim 5 wherein the button member has a cam surface and is configured to press against a portion of the strip passing through the slot in response to pressure from the spring.

7. The strap defined in claim 3 wherein the slider comprises deformable members configured to buckle under external pressure to reduce friction between the slider and a portion of the strip passing through the slot.

8. The strap defined in claim 3 wherein the slider comprises a pair of wheels configured to engage edge portions of the strip passing through the slot.

9. The strap defined in claim 3 wherein the slider comprises a metal outer shell and a polymer core.

10. The strap defined in claim 3 wherein the slider comprises a body through which the slot passes, a pin configured to couple to an end of the strip, and structures configured to hold the pin and the end of the strip at a fixed location within the body.

11. The strap defined in claim 10 wherein the body comprises an additional slot through which the end of the strip passes to the pin.

12. The strap defined in claim 11 further comprising an opening in the body and a cap configured to cover the opening.

13. The strap defined in claim 1 further comprising a first opening in the first portion of the strip that receives the first snap, a second opening in the second portion of the strip that receives the second snap, and a third opening in a third portion of the strip that receives the third snap.

14. A strap configured to removably couple to an item, comprising:

a strip of material configured to form a first loop that couples the strap to the item and configured to form a second loop; and a three-part snap mechanism having a first snap coupled to a first portion of the strip, a second snap coupled to a second portion of strip, and a third snap coupled to the second portion of the strip, wherein the first, second, and third snaps are configured to snap together, the first snap is between the third snap and the second snap when the first, second, and third snaps are snapped together, the first snap comprises a first portion and a second portion mounted to the first portion, the second portion of the first snap comprises a polymer ring, and the first snap comprises an opening that passes through the polymer ring.

15. An adjustable strap for an item, comprising:

a strip of material;

a snap mechanism configured to snap together portions of the strip to couple the strip to the item, wherein the snap mechanism comprises first, second, and third snaps coupled to the strip at respective first, second, and third locations, the second snap is between the first and third snaps when the first, second, and third snaps are snapped together, the third snap comprises a protrusion, and the first and second snaps comprise respective first and second openings configured to receive the protrusion; and an adjustable sliding clasp having a first portion that is fixedly attached to an end of the strip and having a slot configured to receive a portion of the strip for sliding motion within the slot.

16. The adjustable strap defined in claim 15 wherein the second snap is configured to rotate relative to the first and third snaps when the first, second, and third snaps are snapped together.

17. The adjustable strap defined in claim 16 wherein the adjustable sliding clasp has a body through which the slot passes and a pin configured to couple to an end of the strip using a looped layer in the strip.

18. An adjustable strap for an item, comprising:

left and right strips;

a snap mechanism configured to form a loop in the right strip that removably attaches the right strip to the item, wherein the snap mechanism comprises first, second, and third snaps that are configured to snap together, the first snap is between the second snap and the third snap when the first, second, and third snaps are snapped together, the third snap comprises a first portion and a second portion mounted to the first portion, the second portion comprises a polymer ring, and the third snap comprises an opening that passes through the polymer ring;

a first slider that has a fixed attachment to an end of the right strip and a slot through which a portion of the left strip slides; and a second slider that has a fixed attachment to an end of the left strip and a slot through which a portion of the right strip slides.

19. The adjustable strap defined in claim 18 wherein the first and third snaps are received within respective openings in the right strip, and wherein the second snap is received within an opening in the left strip.

20. The adjustable strap defined in claim 19 wherein the first snap has a post, the second snap has an additional opening, and the opening and the additional opening are configured to receive the post when the first, second, and third snaps are snapped together.

21. The adjustable strap defined in claim 20 further comprising a flexible magnet between outer layers.

22. The adjustable strap defined in claim 18 wherein the left strip comprises fabric and comprises an external polymer layer that covers the fabric along at least part of the left strip and wherein the first slider is configured to slide over the external polymer layer.

* * * * *